US006647876B2

(12) United States Patent
Emery et al.

(10) Patent No.: US 6,647,876 B2
(45) Date of Patent: Nov. 18, 2003

(54) MECHANISM FOR ACTUATING THE THROW-OFF OF CYLINDERS USING ECCENTRIC BOXES

(75) Inventors: David Crowell Emery, York, ME (US); Michael Robert Lemelin, Madbury, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/022,644

(22) Filed: Dec. 18, 2001

(65) Prior Publication Data

US 2002/0112626 A1 Aug. 22, 2002

Related U.S. Application Data

(63) Continuation-in-part of application No. 09/603,649, filed on Jun. 26, 2000, now abandoned.

(51) Int. Cl.[7] ..... B41F 13/36

(52) U.S. Cl. ..... 101/247; 101/144; 101/185; 101/218

(58) Field of Search ..... 101/137, 139, 101/140, 143–145, 182, 185, 216, 218, 247, 375

(56) References Cited

U.S. PATENT DOCUMENTS

| | | | | |
|---|---|---|---|---|
| 3,527,165 A | | 9/1970 | Harless | 101/143 |
| 3,817,174 A | | 6/1974 | Paulson | 101/247 |
| 4,458,590 A | | 7/1984 | Egnaczak et al. | 101/247 |
| 4,458,591 A | | 7/1984 | Guaraldi | 101/247 |
| 4,831,926 A | | 5/1989 | Bowman et al. | 101/247 |
| 4,833,982 A | | 5/1989 | Liebert et al. | 101/247 |
| 5,241,905 A | | 9/1993 | Guaraldi et al. | 101/216 |
| 5,301,609 A | | 4/1994 | Guaraldi et al. | 101/216 |
| 5,421,260 A | | 6/1995 | Dobler | 101/247 |
| 5,445,076 A | | 8/1995 | Sugiyama et al. | 101/247 |
| 5,524,539 A | | 6/1996 | Dobler | 101/247 |
| 5,678,485 A | * | 10/1997 | Guaraldi | 101/247 |
| 5,722,323 A | | 3/1998 | Whiting et al. | 101/247 |
| 6,085,651 A | * | 7/2000 | Defrance et al. | 101/247 |
| 6,227,111 B1 | * | 5/2001 | Dawley et al. | 101/247 |

* cited by examiner

*Primary Examiner*—Stephen R. Funk
(74) *Attorney, Agent, or Firm*—Laurence A. Greenberg; Werner H. Stemer; Ralph E. Locher

(57) ABSTRACT

A printing unit has a frame and a plurality of printing cylinders, including a first plate cylinder, a first blanket cylinder, a second blanket cylinder mounted in the frame and forming a nip with the first blanket cylinder for receiving a web of material to be printed, and a second plate cylinder. A plurality of eccentric boxes are mounted on the cylinders and supported in the frame. A plurality of actuation assemblies are provided that are connected to the eccentric boxes. One of the actuation assemblies is connected to each of the eccentric boxes for moving the eccentric boxes such that the printing cylinders can be selectively positioned between a thrown-off position and an engagement position in regards to adjacent printing cylinders. Because of the use of eccentric boxes, lower rated and less complicated actuation assemblies can be used.

10 Claims, 9 Drawing Sheets

MECHANISM FOR ACTUATING THE THROW-OFF OF CYLINDERS USING ECCENTRIC BOXES

CROSS-REFERENCE TO RELATED APPLICATION

This is a continuation-in-part of application Ser. No. 09/603,649, filed Jun. 26, 2000 now abandoned.

BACKGROUND OF THE INVENTION

1. Field of the Invention

The invention relates, generally, to printing units, and more specifically, to a printing unit having an improved cylinder throw off capability.

2. Description of the Related Art

A printing unit has a plurality of rotatable printing cylinders. For example, an offset printing unit has a plate cylinder and a blanket cylinder. The plate and blanket cylinders are supported at their opposite ends for rotation in a frame of the printing unit. The plate cylinder carries a printing plate having a surface on which an inked image is defined. The blanket cylinder carriers a printing blanket. When the cylinders rotate in the printing unit, the plate on the plate cylinder transfers the inked image to the blanket on the blanket cylinder. The blanket on the blanket cylinder subsequently transfers the inked image to a signature being printed such as a web or sheet.

A printing unit typically includes a skew mechanism to skew the plate cylinder relative to the blanket cylinder. When the plate cylinder is skewed relative to the blanket cylinder, an angular position of the plate on the plate cylinder is changed relative to the blanket on the blanket cylinder. The angular position of the inked image that is transferred from the plate to the blanket and subsequently to the web is likewise changed. The alignment of the image with the web is thus adjusted by adjusting the skew mechanism.

The printing unit also includes a throw-off mechanism. When the printing plate and/or the printing blanket are to be serviced or replaced, the cylinders are moved relative to each other into thrown-off positions. In this manner, the cylinders are spaced from each other to permit access to the printing plate, the printing blanket and the web. The existing throw-off mechanisms have become quite complex and expensive and thus add to the cost and reliability of the printing unit.

SUMMARY OF THE INVENTION

It is accordingly an object of the invention to provide a mechanism for actuating the throw-off of cylinders using eccentric boxes that overcomes the herein-mentioned disadvantages of the heretofore-known devices of this general type, which utilizes eccentric boxes that can be driven by smaller and less complicated actuation assemblies.

With the foregoing and other objects in view there is provided, in accordance with the invention, a printing unit, containing:

- a frame;
- printing cylinders, including:
  - a first plate cylinder;
  - a first blanket cylinder;
  - a second blanket cylinder mounted in the frame and forming a nip with the first blanket cylinder for receiving a web of material to be printed; and
  - a second plate cylinder;

- a plurality of eccentric boxes mounted on the printing cylinders and supported in the frame; and
- a plurality of actuation assemblies, one of the actuation assemblies connected to each of the eccentric boxes for moving the eccentric boxes such that the printing cylinders can be selectively positioned between a thrown-off position and an engagement position in regards to adjacent printing cylinders.

Because of the offset positions of the axes of the eccentric box and a respective cylinder, a rotation of the eccentric box will move the cylinder to a thrown-off position. The eccentric boxes have a mechanical advantage over the prior art devices and can apply the force from the actuation cylinders to the printing cylinders much more effectively than the devices taught in the prior art. Therefore, lower rated and less complicated actuation assemblies can be used which results in reduced manufacturing costs, reduced maintenance costs and higher reliability. In addition, a more compact configuration of the printing unit is also possible.

In accordance with an added feature of the invention, each of the printing cylinders have a first end and a second end, and one of the eccentric boxes is disposed on the first end and the second end of each of the first plate cylinder, the first blanket cylinder and the second plate cylinder.

In accordance with an additional feature of the invention, there are a plurality of bearings disposed in the eccentric boxes for supporting the first plate cylinder, the first blanket cylinder and the second plate cylinder in a journaled manner.

In accordance with another feature of the invention, there are a plurality of cylinder boxes mounted in the frame and housing some of the eccentric boxes. The frame of the printing unit has a gear side and a work side, and the cylinder boxes are supported on the work side of the frame and house the eccentric boxes that are disposed on the first end of the first plate cylinder, the first blanket cylinder and the second plate cylinder. The cylinder boxes each have a pivot point around which the cylinder boxes pivot between a first position in which the eccentric boxes are housed in the cylinder boxes and a second position in which the printing cylinders extend from the frame in a cantilevered manner. In addition, the cylinder boxes each have a moveable part that is movable into an engagement position with the eccentric boxes for clamping the eccentric boxes in position with regard to the cylinder boxes. Each of the cylinder boxes has a lockable toggle handle mechanism connected to the moveable part for moving the moveable part between an open position and an eccentric box clamping position.

In accordance with another added feature of the invention, each of the actuation assemblies has an actuation device selected from the group consisting of pneumatic cylinders, hydraulic cylinders, electrically actuated cylinders and electromagnetic devices, and the actuation assemblies each have a rod member with a first end connected to and driven by a respective actuation device and a second end connected to a respective eccentric box.

In accordance with another additional feature of the invention, there is provided a lever arm connected to the rod member and a link. The link has a first end connected to the lever arm and a second end connected to the respective eccentric box.

In accordance with yet another feature of the invention, the printing cylinders each have an axis and the eccentric boxes each have a main axis offset in regards to the axis of the printing cylinders.

In accordance with a further added feature of the invention, there is provided a plurality of sleeves, and one of the sleeves surrounds each of the eccentric boxes.

In accordance with a concomitant feature of the invention, the eccentric boxes are each formed of a sleeve part and a bearing support part, and the actuation assemblies are connected to the sleeve part of the eccentric boxes. Other characteristic features of the invention are set forth in the appended claims.

Although the invention is illustrated and described herein as embodied in a mechanism for actuating the throw-off of cylinders using eccentric boxes, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of specific embodiments when read in connection with the accompanying drawings.

DESCRIPTION OF THE PREFERRED EMBODIMENTS

Figure 1:
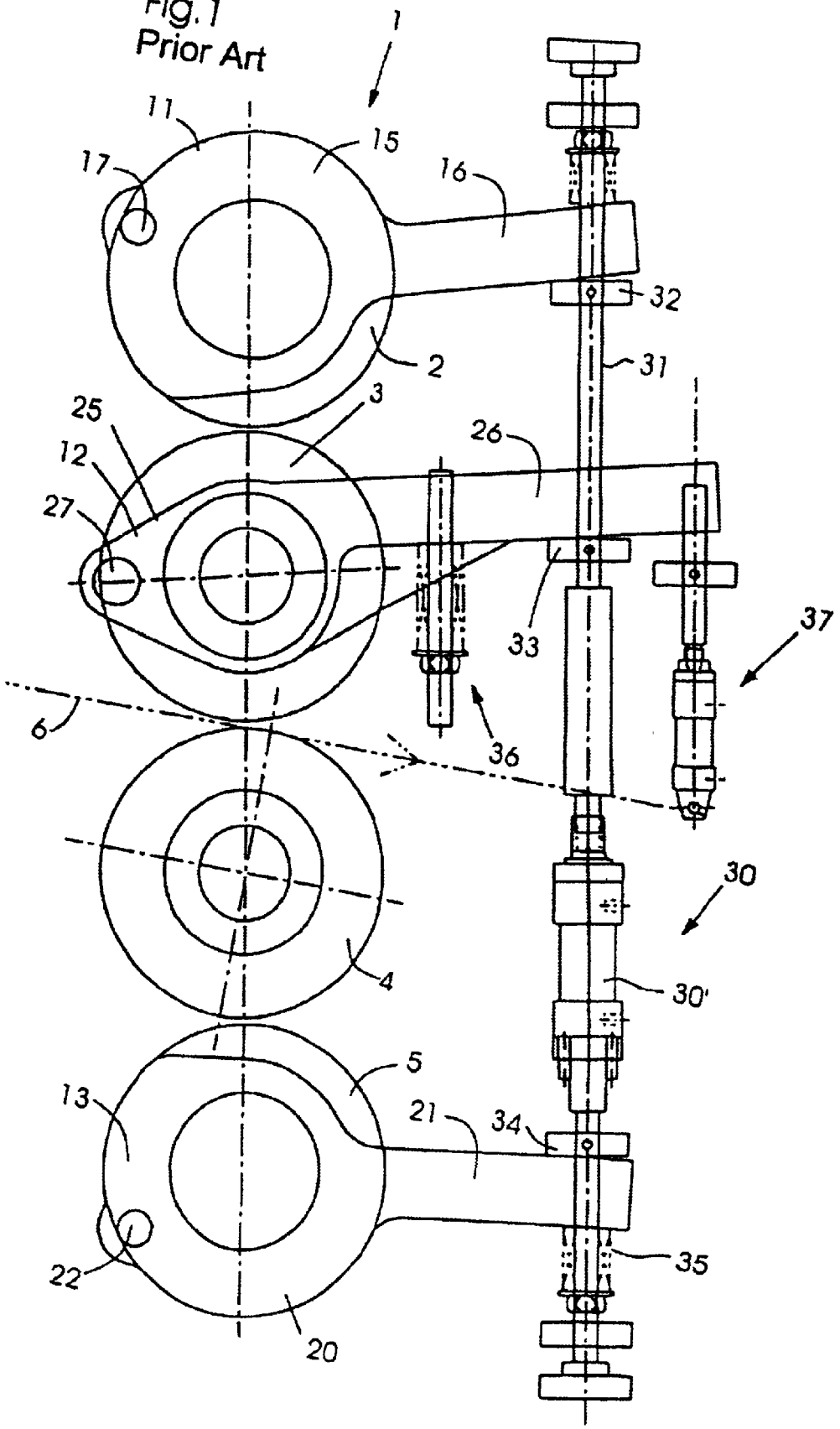
Fig. 1 Prior Art
FIG. 1 is a diagrammatic, side-elevational view of printing cylinders of a printing unit according to the prior art.
Figure 2:
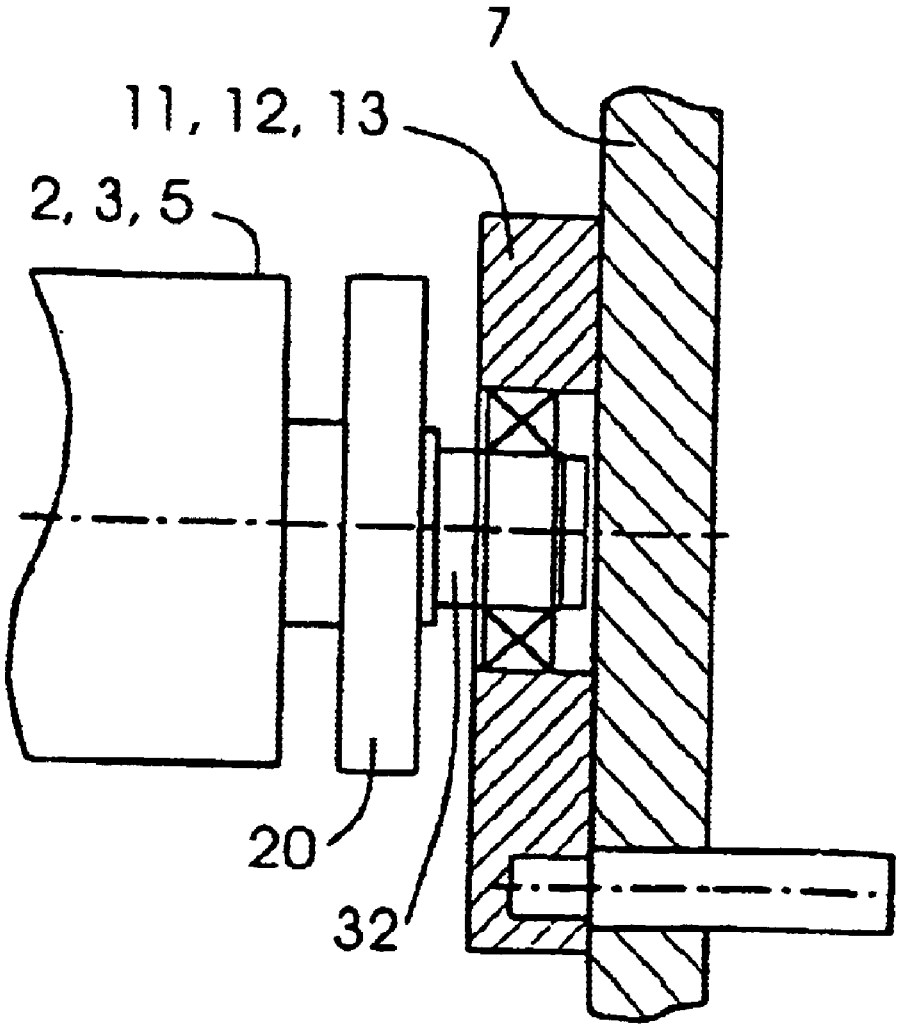
Fig.2 Prior Art
FIG. 2 is a fragmented, sectional view of a connection of a printing cylinder to a frame of the printing unit according to the prior art.

In all the figures of the drawing, sub-features and integral parts that correspond to one another bear the same reference symbol in each case. Referring now to the figures of the drawings in detail and first, particularly, to FIG. 1 thereof, there is shown a prior art printing unit 1 containing an upper (first) plate cylinder 2, an upper (first) blanket cylinder 3, a lower (second) blanket cylinder 4 and a lower (second) plate cylinder 5 for printing a web of material 6. The cylinders 2–5 are all journaled in a wall or frame 7 of a printing press (see FIG. 2).

A first bearing housing 11 is associated with the upper plate cylinder 2, a second bearing housing 12 is associated with the upper blanket cylinder 3, and a third bearing housing 13 is associated with the lower plate cylinder 5. The first bearing housing 11 is formed of a circular main portion 15 and an lever arm 16. The circular main portion 15 is mounted on a pin 17 that is secured to the wall or frame 7 of the printing unit 1 (see FIG. 2).

The third bearing housing 13 is similar to the first bearing housing 11 and is formed of a circular main portion 20 and a lever arm 21. The circular main portion 20 is mounted on a pin 22 that is secured to the wall or frame 7 of the printing unit 1.

The second bearing housing 12 is also formed of a circular main portion 25 and a lever arm 26. The circular main portion 25 is mounted on a pin 27 to the frame 7 of the printing unit 1.

The lower blanket cylinder 4 is fixed to the wall or frame 7 of the printing unit 1.

An actuating assembly 30 has an air cylinder 30' for moving a first rod 31 and a second rod 35. An upper stop 32 associated with the lever arm 16 and a middle stop 33 associated with the lever arm 26 are disposed on the first rod 31. A lower stop 34 associated with the lever arm 21 is disposed on the second rod 35. For obtaining a thrown-off position, the air cylinder 30' moves the first rod 31 in an upward direction such that the stops 32, 33 engage the levers 16, 26 and move the first and second bearing housings 11, 12 about the pins 17, 27, respectively, thus throwing-off the cylinders from each other. The air cylinder 30' also moves the second rod 35 in a downward direction such that the stop 34 engages the lever 21 and moves the third bearing housing 13 about the pin 22, thus throwing-off the lower plate cylinder 5. In essence, the air cylinder 30' acts on the lever arms 16, 21 and 26 for performing the throw-off function. To assist in the throw-off function a spring assembly 36 and a second actuating assembly 37 are provided for controlling the throw-off of the upper blanket cylinder 3.

Figure 3:
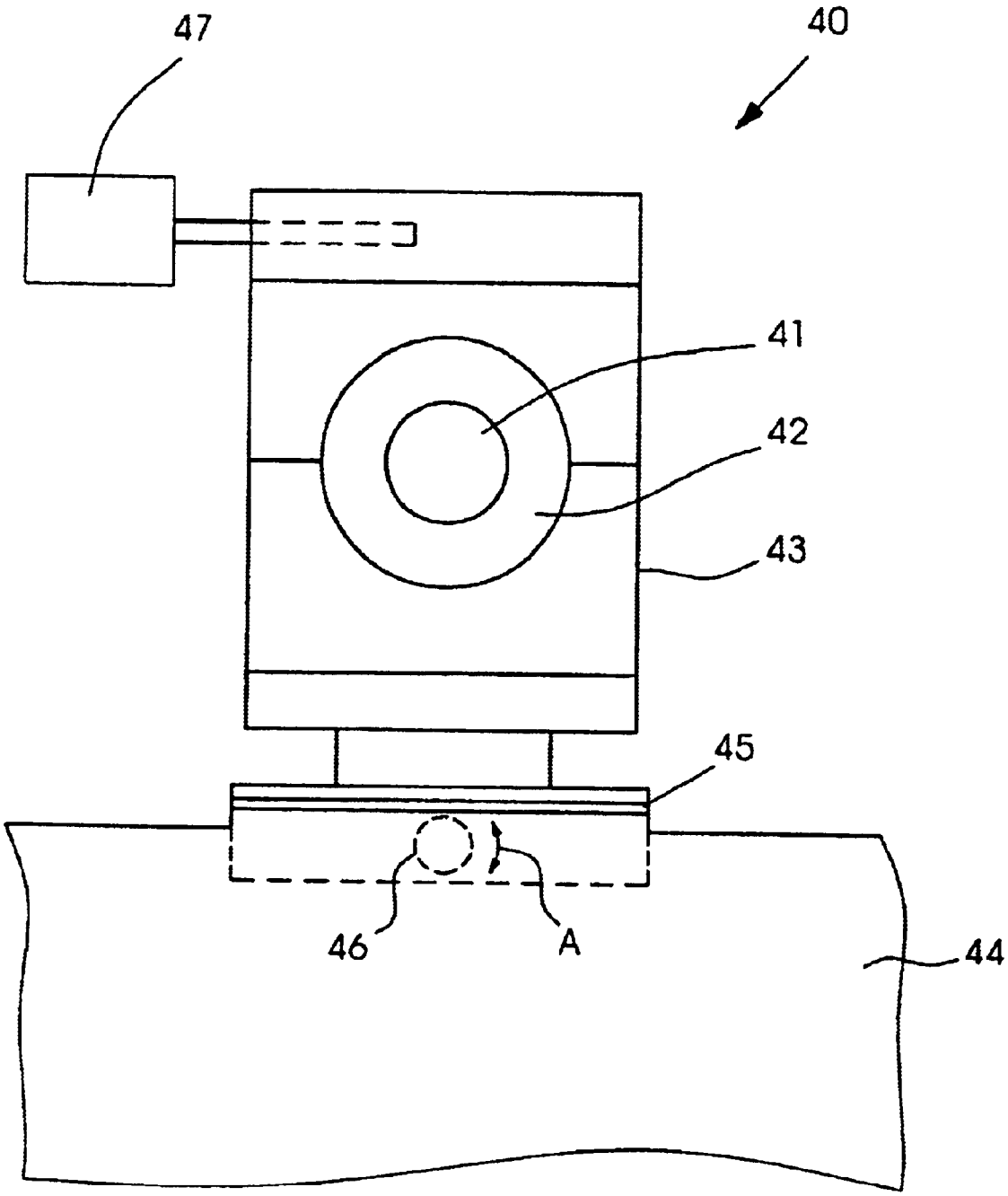
Fig.3 Prior Art
FIG. 3 is a side-elevational view of the printing cylinder held in a cylinder box according to the prior art.

FIG. 3 shows a detailed view of part of another prior art printing press 40 in which the throw-off mechanism for only one of the cylinders is shown. A shaft 41 of a cylinder is held by a bearing 42 that is in turn held in a cylinder box 43. The cylinder box 43 is affixed in a dual pivotal manner to a frame 44 of the printing press 40. The cylinder box 43 can be pivoted about a first pivot point 45 in which the cylinder box 43 is lowered (i.e. perpendicular to the page) and disengages from the cylinder. In this manner access is provided to one end of the cylinder. In addition, the cylinder box 43 has a second pivot point 46 pivotable in the directions shown by the double-headed arrow A. In this manner, the cylinder box 43 holding the cylinder can be moved into a thrown-off position to assist in exchanging a blanket or plate on the cylinder and other maintenance functions. An air cylinder 47 is connected to the cylinder box 43 for pivoting the cylinder box 43 around the second pivot point 46 for moving the cylinder to the thrown-off position. The shown air cylinder 47 must be rated to be able to move the complete assembly formed of the cylinder box 43, the bearing 42, the cylinder and other associated parts.

Figure 4:
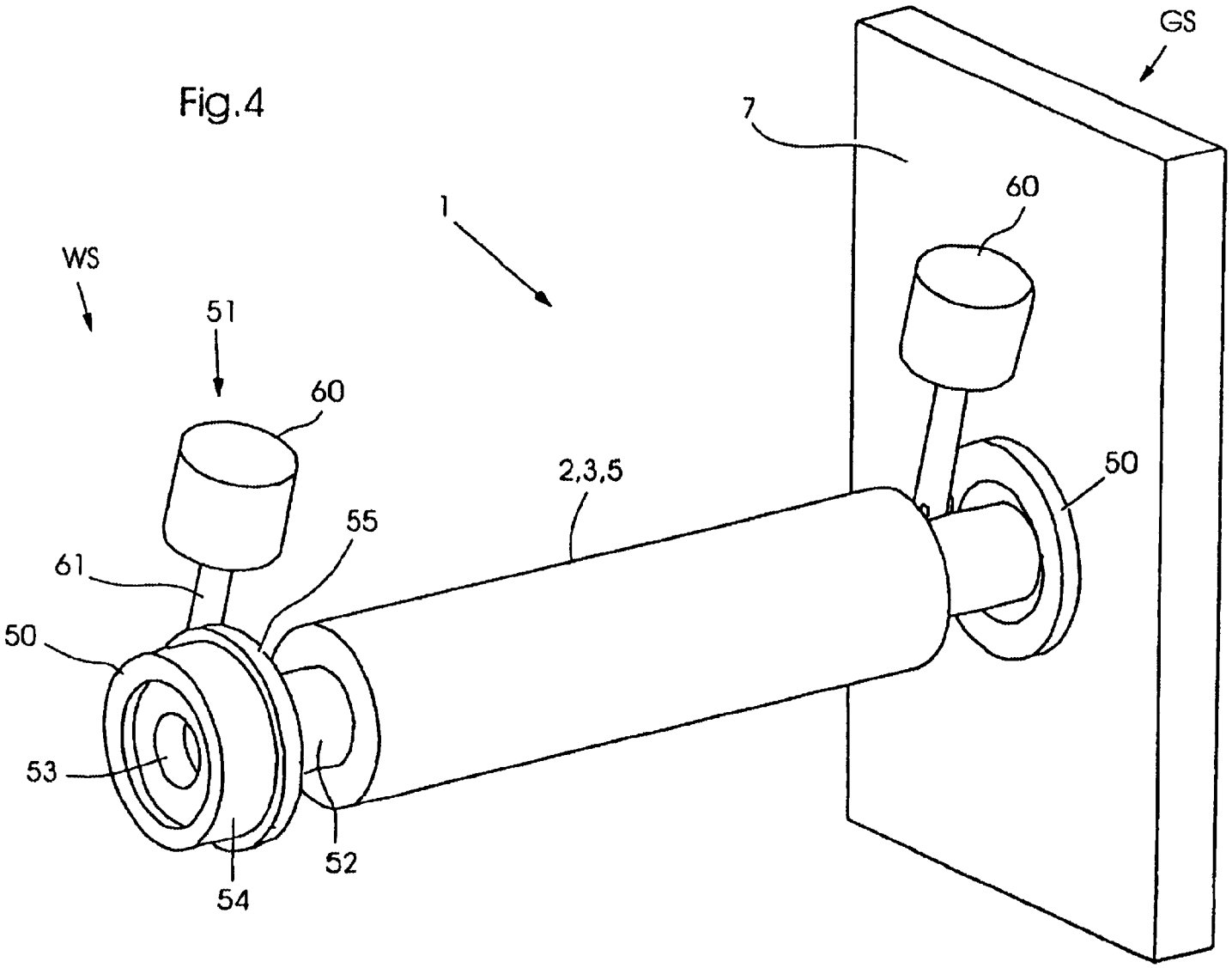
FIG. 4 is a perspective view of an eccentric box and an associated actuation assembly for throwing off the printing cylinder according to the invention.

In contrast, FIG. 4 shows the invention of the instant application in which the printing unit 1 has the throw-off function accomplished by a eccentric box 50 that is actuated by an actuation assembly 51. The plate or blanket cylinder 2, 3, 5 is journaled in the eccentric box 50. The eccentric box 50 has a sleeve part 55 and a bearing housing part 54 that holds bearings 53. The cylinders 2, 3, 5 each have a cylinder shaft 52 rolling on the bearings 53 contained in the eccentric box 50. On a gear side GS, the eccentric box 50 is housed in the frame 7 of the printing unit 1 and the cylinders 2, 3, 5 extend in a cantilevered fashion from the gear side GS to a work side WS. The gear side GS refers to that end of the cylinders 2, 3, 5 that are driven and the work side WS refers to the other end of the cylinders 2, 3, 5 in which access is provided to the cylinders 2, 3, 5 for performing maintenance functions. The fixation of the eccentric box 50 on the work side WS is omitted from FIG. 4 for clarity purposes and is discussed below with regard to FIG. 6.

Figure 5:
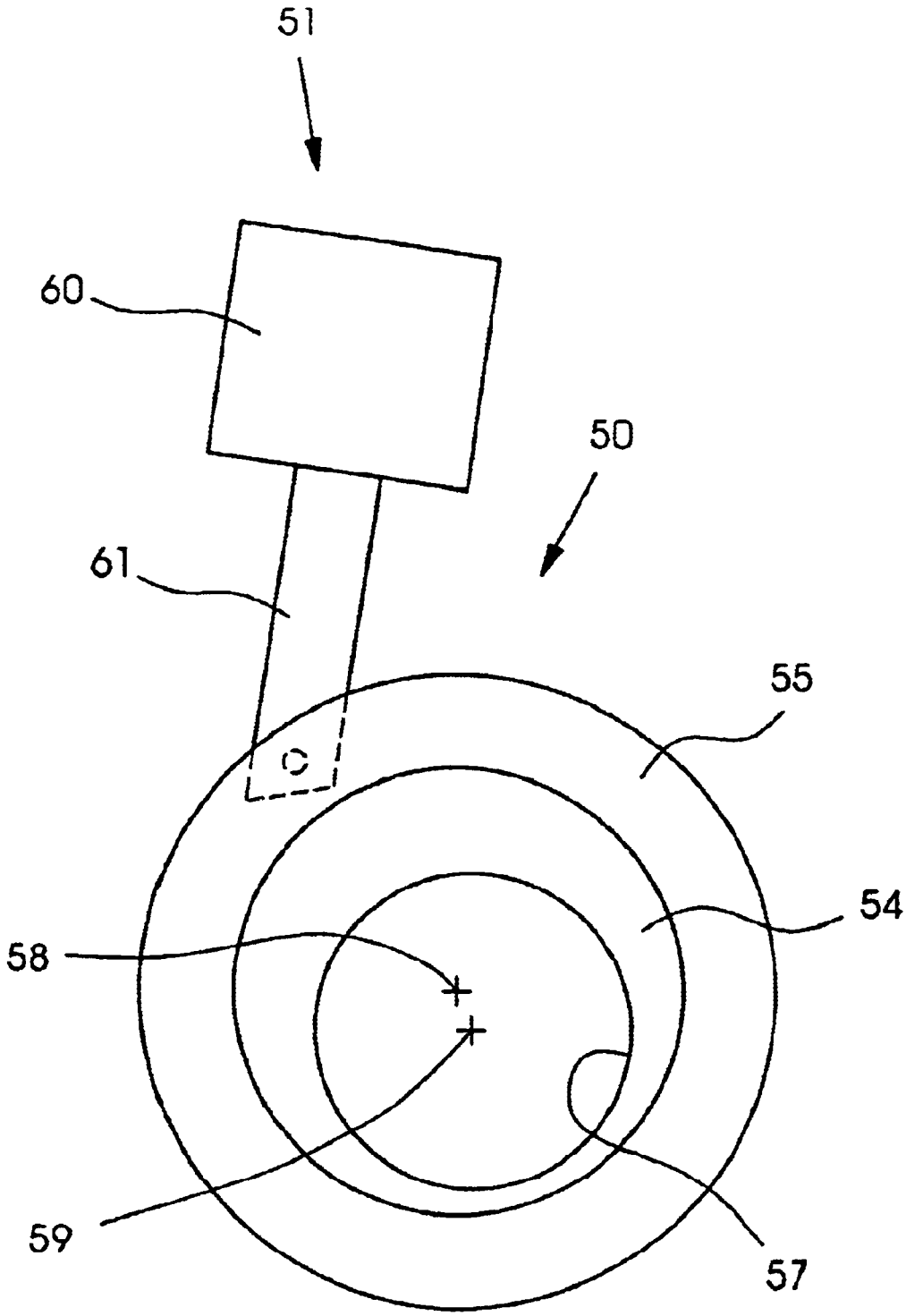
FIG. 5 is a side-elevational view of the eccentric box and the actuation assembly shown in FIG. 4.

FIG. 5 shows the eccentric box 50 formed of the sleeve 55 and the bearing support 54. A bore 57 formed in the bearing support 54 is positioned in an eccentric manner in regards to a main axis 58 of the eccentric box 50. As shown in FIG. 5, the main axis 58 of the eccentric box 50 is offset in regards to an axis 59 of the bore 57. The bore 57 houses the bearings 53 for carrying the printing cylinders 2, 3, 5. The axis 59 of the bore 57 is also approximately an axis of the cylinders 2, 3, 5 journaled in the eccentric box 50. It is noted that the eccentric box 50 shown in FIG. 5 is slightly exaggerated to assist in understanding the invention.

The actuation assembly 51 is formed of an actuation device 60 such as a pneumatic cylinder, a hydraulic cylinder, an electrically actuated cylinder or an electromagnetic device. The actuation device 60 is connected to a rod member 61 that in turn is connected to the eccentric box 50, and more specifically to the sleeve 55 of the eccentric box 50. Alternatively, the rod member 61 could attach to the bearing support 54. By driving the actuation device 60, the eccentric box 50 is rotated about its main axis 58 which is off-center with respect to the axis of the cylinders 2, 3, 5. As the main axis 58 of the eccentric box 50 is off-center to the bore axis 59, the axis of the cylinders 2, 3, 5, will also be offset in regards to the main axis 58 of the eccentric box 50. Therefore, the cylinders 2, 3, 4, 5 will move apart from each other and then towards each other as the eccentric box 50 is rotated about the main axis 58 by the actuation device 60.

Figure 6:
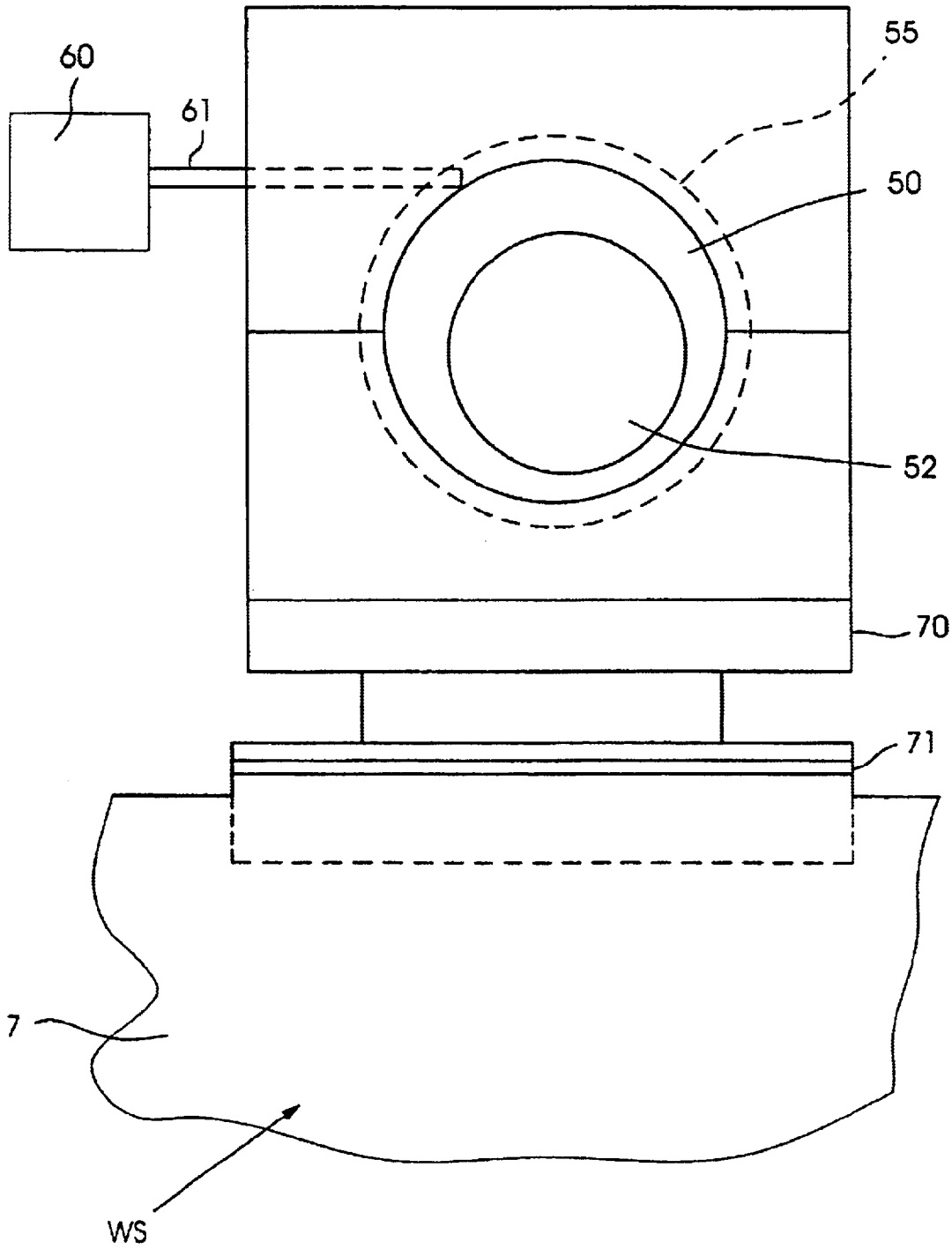
FIG. 6 is a side-elevational view of the cylinder box.
Figure 7:
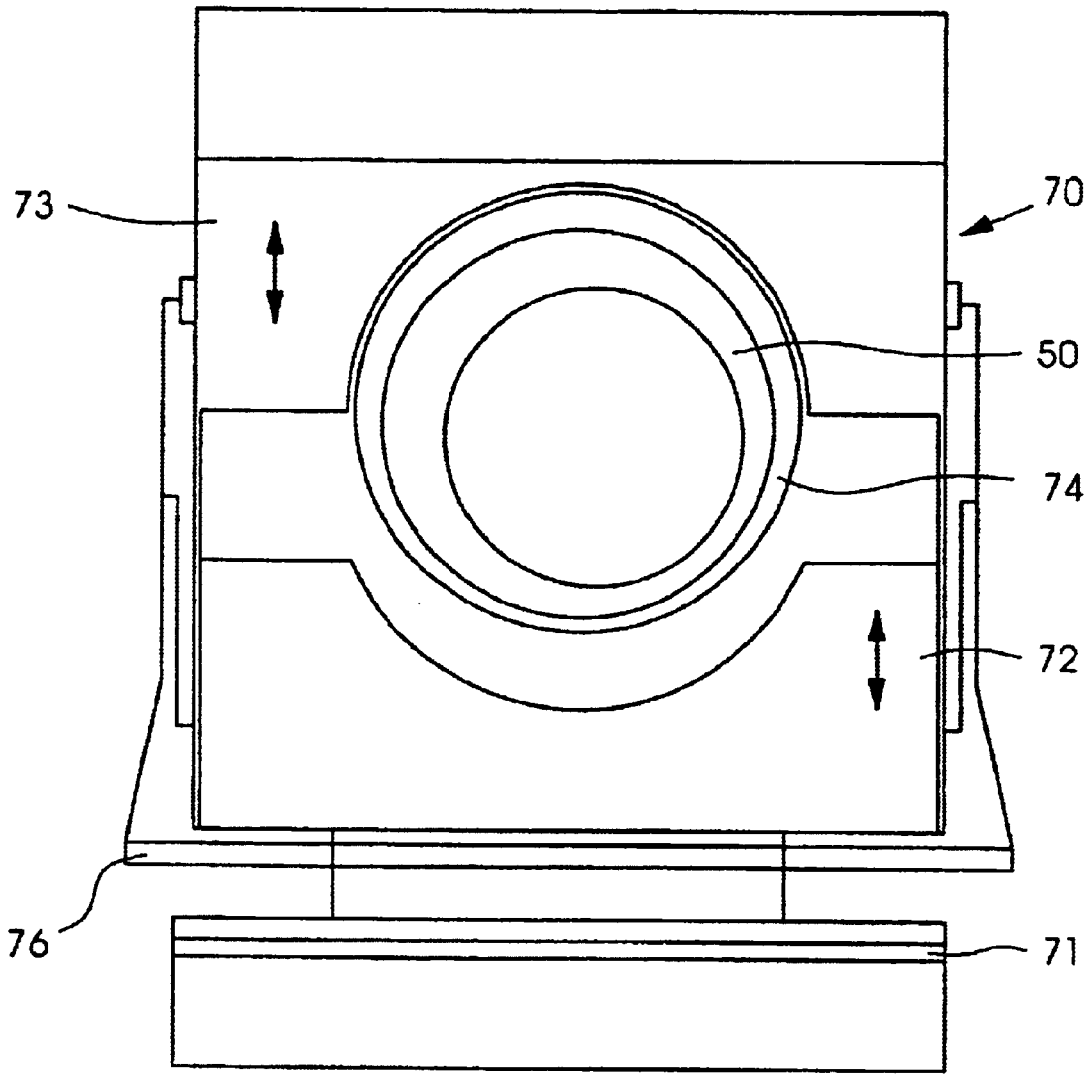
FIG. 7 is a side-elevational view of a splittable cylinder box.

FIG. 6 shows how the eccentric box 50 is affixed to the frame 7 of the printing unit 1 on the work side WS. The eccentric box 50 is held in a cylinder box 70 that is in turn mounted to the frame 7. The cylinder box 70 has a pivot point 71 for lowering (pivoted perpendicular to the page of FIG. 6) the cylinder box 70 away from the eccentric box 50 that is normally supported in the cylinder box 70. In this way, the cylinder 2, 3, 5 can be held in the cantilevered fashion as shown in FIG. 4 because the cylinder box 70 is pivoted out of engagement with the eccentric box 50 housing the cylinder 2, 3, 5. FIG. 7 illustrates the cylinder box 70 as a splittable cylinder box 70 having a lower cylinder box part 72 and an upper cylinder box part 73. At least the lower cylinder box part 72 and optionally the upper cylinder box part 73 are movable to allow better access to and clamping of the eccentric box 50. A lockable toggle handle mechanism 76 attaches to the lower cylinder box part 72 and optionally to the upper cylinder box part 73 for moving the lower and upper cylinder box parts 72, 73 away from and to the eccentric box 50 as the handle mechanism 76 is toggled between an open and a clamped position. FIG. 7 also shows an optional sleeve 74 fitted around the eccentric box 50 so that the cylinder box 70 engages around the sleeve 74 rather than directly on the eccentric box 50. When the splittable cylinder box 70 in the opened position and pivoted away, the eccentric box 50 remains attached to the cylinder 2, 3, 5 that now extends in the cantilevered fashion from the gear side GS.

By throwing-off the cylinders 2, 3 and 5, and pivoting the cylinder box 70, one has access to the cylinders 2, 3, 4 and 5 for exchanging the blankets and or plates attached to the cylinders. In addition, once the eccentric box 50 is positioned in the thrown-off position, the actuation assembly 51 is in an over-toggle position and self holds itself in that position.

Because the eccentric box 50 is positioned in the cylinder box 70 and the actuation assembly 51 is directly connected to the eccentric box 50, and not the cylinder box 70, the invention of the instant application has advantages over the previously discussed prior art. First, the connection of the actuation assembly 51 directly to the eccentric box 50 has a mechanical advantage of about five (5) times greater than when the actuation assembly 47 is connected to the cylinder box 43 (FIG. 3) or the bearing housing 11–13 with the actuated lever arms of the prior art shown in FIG. 1. As the invention of the instant application has five (5) times the mechanical advantage, smaller actuation devices 60 can be used for similar loads than is presently possible with the prior art. Because a smaller rated actuation device 60 is needed to move the same loads as in the prior art, the actuation assemblies 51 are less expensive and require less space for their incorporation in the printing unit 1. Furthermore, the actuation assemblies 51 require a less complicated configuration as the stops used on the prior art are not necessary. In addition, the cylinder box 70 is less complicated to manufacture as only one pivot point 71 is necessary, as contrasted with the two pivot points 45, 46 necessary in the prior art cylinder box 43 shown in FIG. 3.

Figure 8:
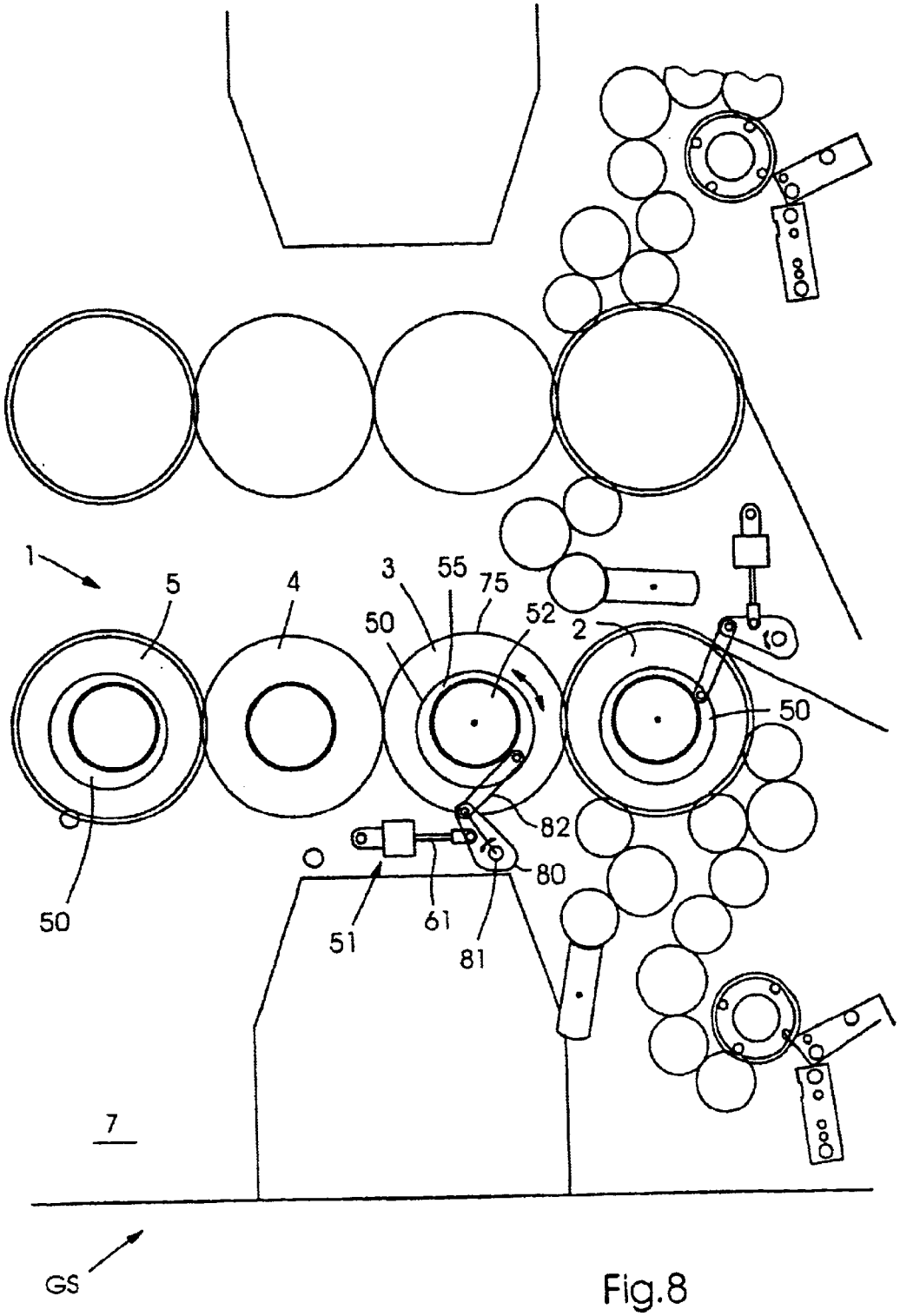
FIG. 8 is a sectional view of the cylinders of the printing unit with a linkage assembly connecting the eccentric box to the actuating assembly.

FIG. 8 shows a second embodiment of the invention in which the cylinders 2–5 are support by the frame 7 on the gear side GS of the printing unit 1 and the works side WS is shown in the cantilevered fashion. In the second embodiment, the rod member 61 of the actuation assembly 51 is connected to a lever arm 80 that is supported in the frame 7 by a pin 81. The lever arm 80 is connected to a link 82 that is connected to the eccentric box 50. In this manner, the actuation assembly 51 throws off the cylinders 2, 3, 5 via the lever arm 80 and the link 82. In the second embodiment, a blanket sleeve 75 is removed by sliding the blanket sleeve 75 over the eccentric box 50 as the eccentric box 50 remains attached to the cylinder shaft 52.

Figure 9:
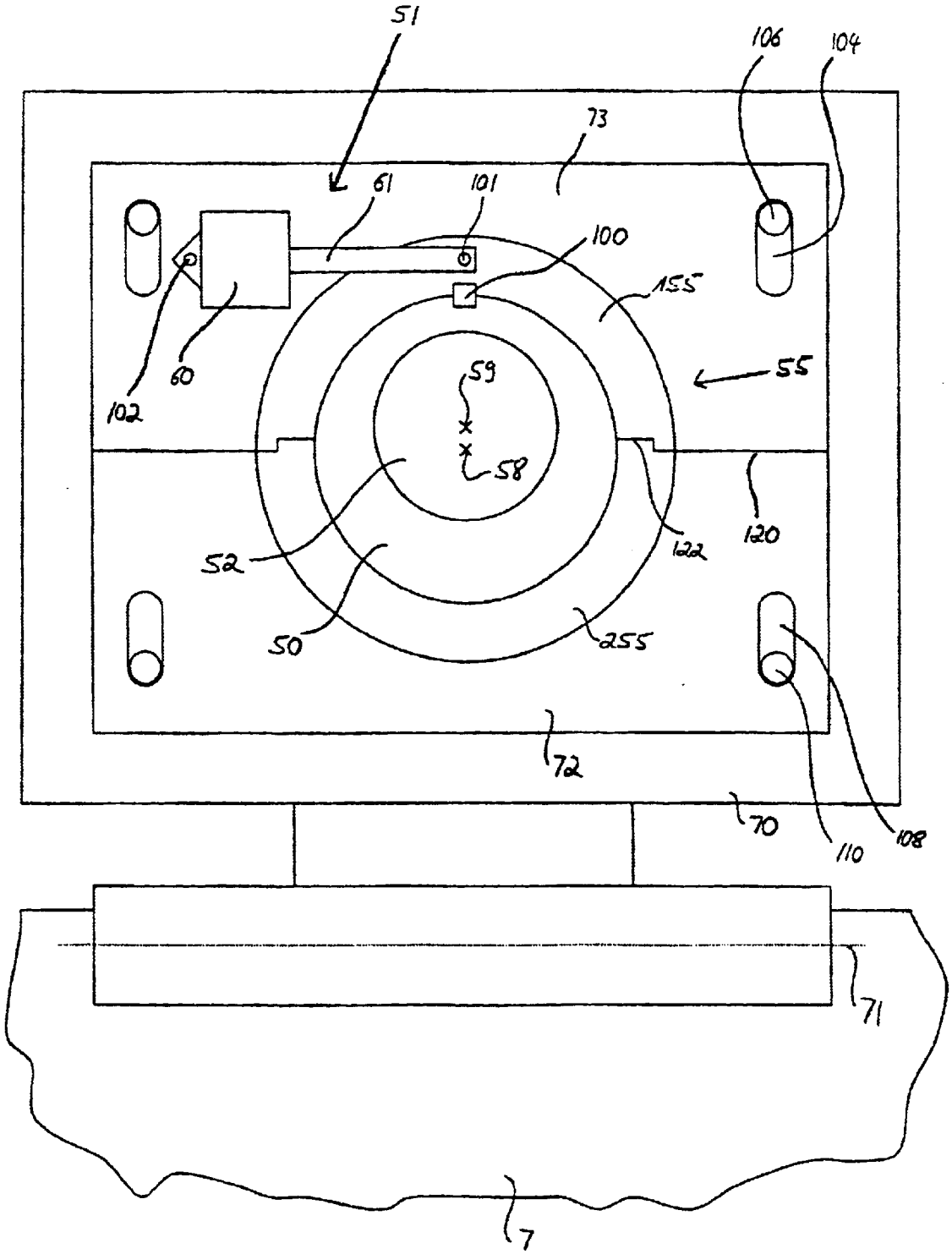
FIG. 9 is a fragmentary side-elevational view of a splittable cylinder box and a splittable cylinder sleeve according to the invention.

FIG. 9 shows the cylinder shaft 52 with the axis 59, which is supported by the bearing of the eccentric box 50 having the axis 58. The figure also shows a sleeve 55, which surrounds the eccentric box 50, the sleeve 55 includes an upper sleeve part 155 and a lower sleeve part 255 which is mounted for rotational movement within the upper cylinder box part 73 and the lower cylinder box part 72 of the cylinder box 70. The actuation assembly 51 including the air cylinder 60 and the rod member 61, the actuation assembly being mounted to the upper cylinder box part 73 by the pivot point 102 and to the upper sleeve part 155 of the sleeve 55 by the pivot point 101. The actuation assembly 51 applies a force to the sleeve 55 thereby rotating the sleeve 55 and the eccentric box 50. A key 100 can be used to transfer the rotational movement of the sleeve 55 to the eccentric box 50. The actuation of the actuating assembly 51 leads to the rotation of the sleeve 55 and the eccentric box 50 so that the cylinder having the cylinder shaft 52 is moved to a throw-off position, for example to replace the sleeve 55.

The blanket cylinder sleeve 55 can be removed from the cylinder by separating the upper cylinder box part 73 and the lower cylinder box part 72 of the cylinder box 70 along the line 120 and moved to a respective separated position, which can be limited by the length of the slotted hole 104 and the position of the pin 106. The actuating assembly 51 and the upper sleeve part 155 of the sleeve 55 move in connection with the upper cylinder box part 73 of the cylinder box 70, as opposed to the lower sleeve part 255 of the sleeve 55, which moves in connection with the lower cylinder box part 73 of the cylinder box 70. The length of the slotted hole 108 and the location of the pin 110 limit the movement of the lower cylinder box part 72 of the cylinder box 70.

After separating the upper and lower cylinder box parts 72, 73 of the cylinder box 70, the whole cylinder box 70 can be pivoted at pivot line 71 defined by a pivot axis, which is part of the mounting device of the cylinder box 70 to the frame 7. The separation of the upper and lower cylinder box parts 72, 73 of the cylinder box 70 can be made automatic or manual by using additional air cylinders or by a toggle clamp mechanism, respectively. The separation of the upper and lower cylinder box parts 72, 73 of the cylinder box 70 causes the separation of the upper sleeve 155 and the lower sleeve 255 at the separation line 122. The separation allows a blanket sleeve 75 to be moved from the cantilevered end of the blanket cylinder 3, 4, and the replacement sleeve can be placed on the blanket cylinder 3, 4 over the free end of the cylinder.

We claim:

1. A printing unit, comprising:

a frame;

a plurality of printing cylinders including a first plate cylinder, a first blanket cylinder, a second blanket cylinder mounted in said frame and forming a nip with said first blanket cylinder for receiving a web of material to be printed, and a second plate cylinder;

a plurality of eccentric boxes mounted on said printing cylinders and supported in said frame, each of said eccentric boxes being formed of a sleeve part and a bearing support part;

said sleeve part being a split sleeve part that can be separated;

a plurality of cylinder boxes mounted in said frame and housing some of said eccentric boxes, said cylinder boxes each having a pivot point around which said cylinder boxes pivot between a first position in which said eccentric boxes are housed in said cylinder boxes and a second position in which said printing cylinders extend from said frame in a cantilevered manner, and said cylinder boxes each having a moveable part that is movable into an engagement position with said eccentric boxes for clamping said eccentric boxes in position with regard to said cylinder boxes;

sleeves respectively surrounding each of said eccentric boxes; and a plurality of actuation assemblies, one of said actuation assemblies being connected to each of said eccentric boxes for moving said eccentric boxes such that said printing cylinders can be selectively positioned between a thrown-off position and an engagement position with respect to adjacent ones of said printing cylinders, said actuation assemblies being respectively connected to said sleeve part of said eccentric boxes.

2. The printing unit according to claim 1, wherein said first and second plate cylinders have respective axes and said eccentric boxes each have a main axis offset in regard to a respective one of said axes of said first and second plate cylinders.

3. The printing unit according to claim 1, wherein at least one of said plate cylinders has a shaft with a first end housed in a respective one of said eccentric boxes which, in turn, is housed in one of said cylinder boxes and a second end housed in another respective one of said eccentric boxes which, in turn, is housed in said frame.

4. The printing unit according to claim 1, wherein each of said printing cylinders has a first end and a second end, and one of said eccentric boxes is respectively disposed on said first end and said second end of each of said first plate cylinder, said first blanket cylinder, and said second plate cylinder.

5. The printing unit according to claim 4, including a plurality of bearings disposed in said eccentric boxes for respectively supporting said first plate cylinder, said first blanket cylinder, and said second plate cylinder in a journaled manner.

6. The printing unit according to claim 5, wherein said frame has a gear side and a work side, and said cylinder boxes are supported on said work side of said frame and house said eccentric boxes respectively disposed on said first end of said first plate cylinder, said first blanket cylinder, and said second plate cylinder.

7. The printing unit according to claim 1, wherein each of said cylinder boxes has a lockable toggle handle mechanism connected to said moveable part for moving said moveable part between an open position and an eccentric box clamping position.

8. The printing unit according to claim 1, wherein each of said actuation assemblies has an actuation device selected from the group consisting of pneumatic cylinders, hydraulic cylinders, electrically actuated cylinders, and electromagnetic devices, and said actuation assemblies each have a rod member with a first end connected to and driven by a respective actuation device and a second end connected to a respective eccentric box.

9. The printing unit according to claim 8, including:

a lever arm connected to said rod member; and a link having a first end connected to said lever arm and a second end connected to said respective eccentric box.

10. The printing unit according to claim 1, wherein said printing cylinders each have an axis and said eccentric boxes each have a main axis offset in regards to said axis of said printing cylinders.

* * * * *